US008475199B2

(12) United States Patent
Wang et al.

(10) Patent No.: US 8,475,199 B2
(45) Date of Patent: Jul. 2, 2013

(54) PLUG CONNECTOR HAVING AN IMPROVED RELEASING MECHANISM

(75) Inventors: Chien-Chiung Wang, New Taipei (TW); Qing-Man Zhu, Kunshan (CN); Peng Zhai, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 20 days.

(21) Appl. No.: 13/340,612

(22) Filed: Dec. 29, 2011

(65) Prior Publication Data

US 2012/0171879 A1 Jul. 5, 2012

(51) Int. Cl.
*H01R 13/62* (2006.01)

(52) U.S. Cl.
USPC ..... 439/353; 439/160; 439/352

(58) Field of Classification Search
USPC ..... 439/152, 160, 352, 353, 358
See application file for complete search history.

(56) References Cited

U.S. PATENT DOCUMENTS

| | | | | |
|---|---|---|---|---|
| 6,746,264 | B1 | 6/2004 | Branch et al. | |
| 7,281,937 | B2 | 10/2007 | Reed et al. | |
| 7,736,171 | B2 | 6/2010 | Reed et al. | |
| 8,025,519 | B2 * | 9/2011 | Handshaw et al. | 439/352 |
| 8,267,713 | B2 * | 9/2012 | Wu | 439/352 |

* cited by examiner

*Primary Examiner* — Khiem Nguyen
(74) *Attorney, Agent, or Firm* — Wei Te Chung; Ming Chieh Chang

(57) ABSTRACT

A plug connector (100) mating with a complementary connector has a housing (1) defining a latching recess (117), a cover (3) and a releasing mechanism including a puller (5) and a latch (4) operable by the puller. The latch has a latching portion (42). The latching portion includes a resisting portion (423) for engaging the cover and a claw (424) in front of the resisting portion and projecting toward a first direction. The resisting portion, in response to a rearward movement of the puller, is movable to engage the cover and to pivot the claw from a latched position to a released position where the claw is received in the latching recess along a second direction opposite to the first direction.

20 Claims, 7 Drawing Sheets

PLUG CONNECTOR HAVING AN IMPROVED RELEASING MECHANISM

BACKGROUND OF THE INVENTION

1. Field of the Invention

The present invention generally relates to a plug connector, and more particularly to a plug connector for application in high speed signal transmission.

2. Description of Related Art

U.S. Pat. No. 6,746,264 issued to Branch on Jun. 8, 2004 discloses a plug connector mating with a complementary connector. The plug connector comprises a housing and a releasing mechanism assembled to the housing. The releasing mechanism includes a latch having a hook, an engaging portion and a pivot portion disposed between the hook and engaging portion, and a puller having a ball portion. When the puller is pulled rearwardly, the ball portion slides on the engaging portion to pivot the latch about the pivot portion. The hook is withdrawn from a latched position to a released position.

A plug connector having a differently configured releasing mechanism is desired.

BRIEF SUMMARY OF THE INVENTION

Accordingly, an object of the present invention is to provide a plug connector having a releasing mechanism having a simple configuration and capable of taking an easy operation.

In order to achieve the above-mentioned object, a plug connector mating with a complementary connector comprises a housing, a cover and a releasing mechanism including a puller and a latch operable by the puller. The latch has a latching portion. The latching portion includes a resisting portion for engaging the cover and a claw in front of the resisting portion and projecting toward a first direction. The resisting portion, in response to a rearward movement of the puller, is movable to engage the cover and to pivot the claw from a latched position to a released position where the claw is received in the latching recess along a second direction opposite to the first direction.

It is easy to drive the releasing mechanism to perform the latching and releasing operation, if only rearwardly pulling the puller or releasing the puller. The releasing mechanism has a simple configuration and is capable to take an easy operation.

Other objects, advantages and novel features of the invention will become more apparent from the following detailed description of the present embodiment when taken in conjunction with the accompanying drawings.

DETAILED DESCRIPTION OF THE INVENTION

Figure 1:
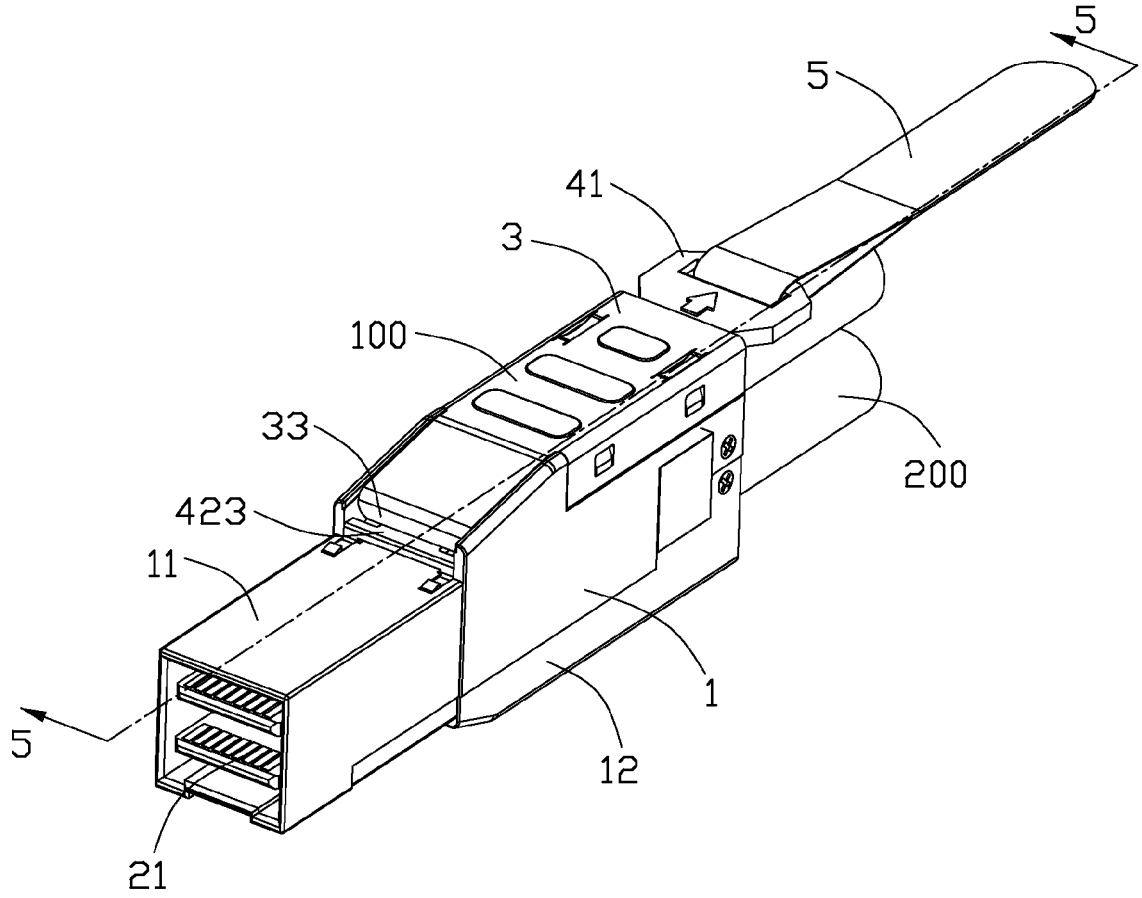
FIG. 1 is an assembled perspective view of a plug connector in accordance with the present invention.
Figure 2:
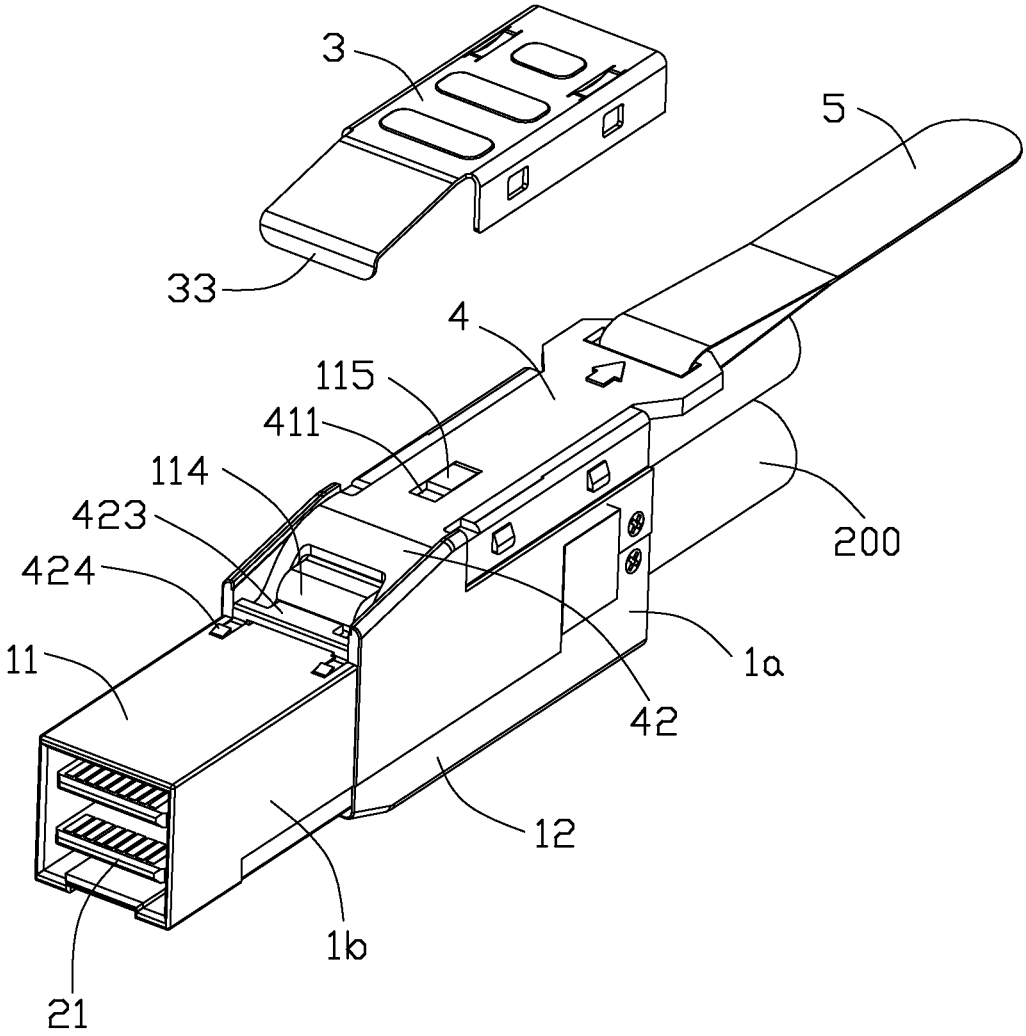
FIG. 2 is a partially exploded perspective view of the plug connector as shown in FIG. 1, with a cover separated from a housing.
Figure 3:
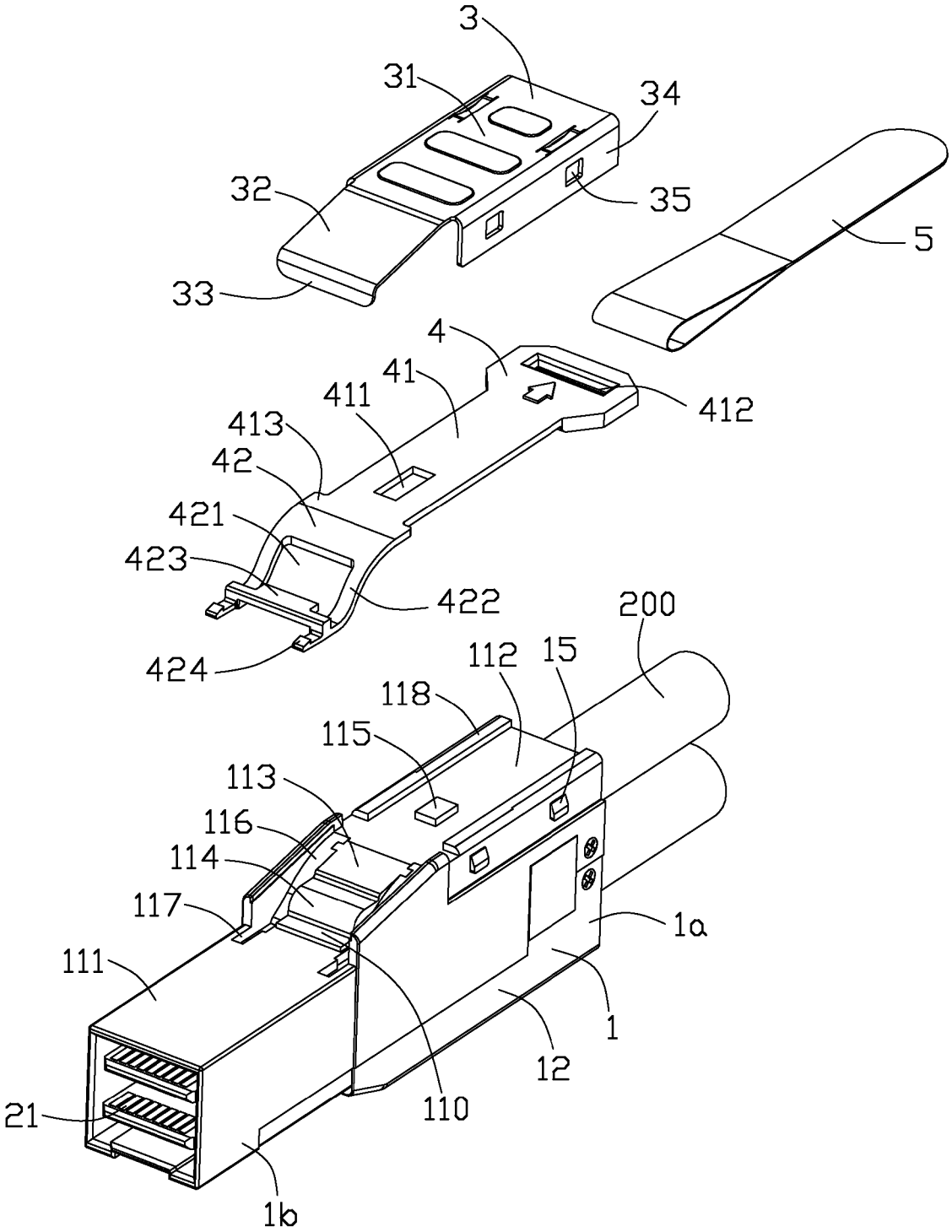
FIG. 3 is a further partially exploded perspective view of the plug connector as shown in FIG. 2, with the cover and the releasing mechanism separated from the housing.
Figure 4:
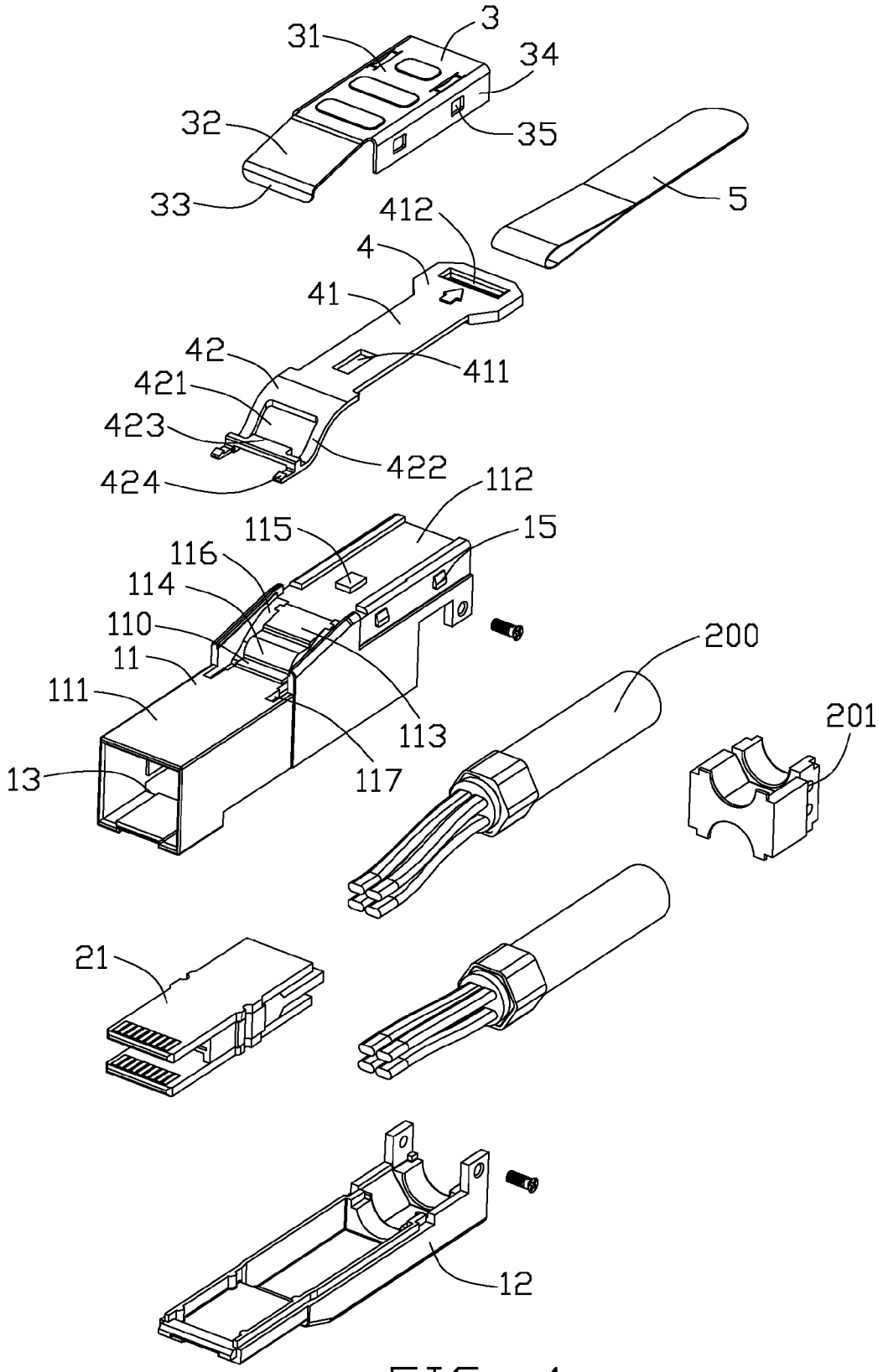
FIG. 4 is an exploded view showing the plug connector.
Figure 5:
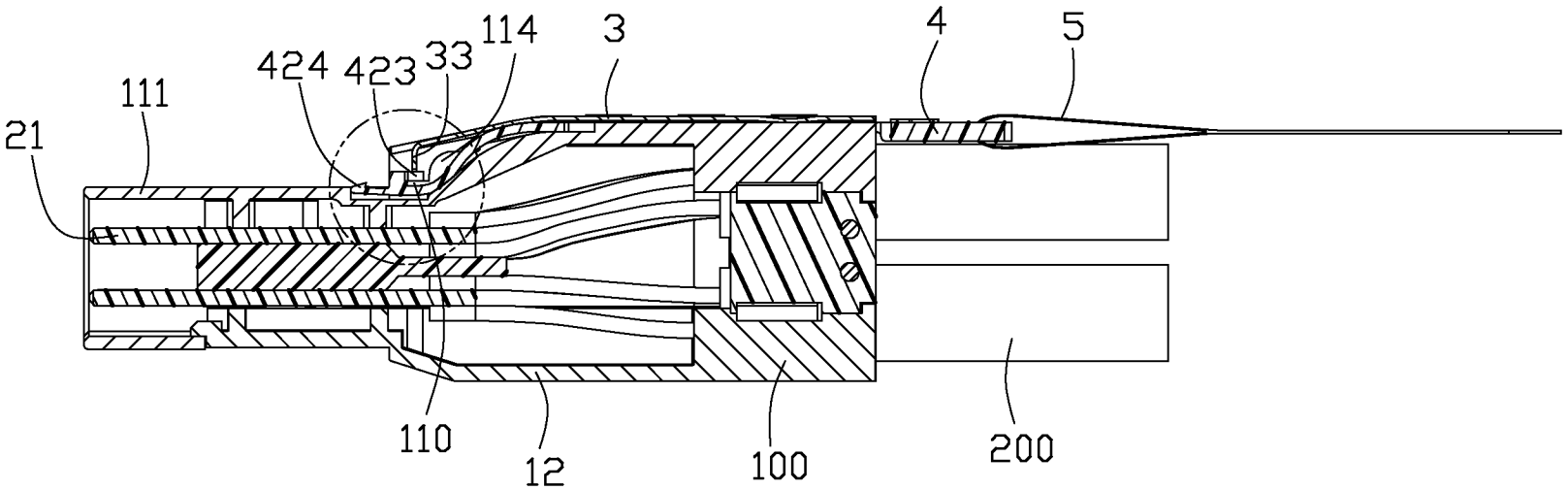
FIG. 5 is a cross-sectional view of the plug connector situated in a latched position, taken along line 5-5 of FIG. 1.

Reference will now be made to the drawing figures to describe the present invention in detail.

Referring to FIGS. 1-5, a plug connector 100 mating with a complimentary connector (not shown) and connected with a cable 200 via a bracket 201 in accordance with the present invention comprises a housing 1, a pair of circuit boards 21, a releasing mechanism assembled to the housing 1, a cover 3 attached to the housing 1 and partially covering the releasing mechanism. If desired, the cable 200 can be replaced by other suitable structures or interfaces.

The housing 1 comprises an upper portion 11 and a lower portion 12 engaged with each other to define a receiving space 13 therebetween for retaining the pair of circuit boards 21. Both upper portion 11 and lower portion 12 are preferably die-casted.

The upper and lower portions 11, 12 of the housing 1 together defines a base 1*a* and an elongated tongue portion 1*b* extending forwardly from the base 1*a* for fitting with the complementary connector. The base 1*a* has a top face 112 and a slope 113. The base 1*a* has a pair of ribs 118 formed on the top face 112, a receiving recess 112 between the pair of ribs 118, and a tab 115 formed in the receiving recess 112. The slope 113 has a pair of inclining recesses 116 defined at two opposite sides thereof and a projecting portion 114 formed between the pair of inclining recesses 116. The base 1*a* includes a plurality of locking protrusions 15 formed on side faces of the base 1*a*. The tongue portion 1*b* has an upper face 111 lower than the top face 112, a platform 110 formed adjacent to the projecting portion 114 and a pair of latching recesses 117 downwardly concaved from the upper surface 111.

The releasing mechanism includes a latch 4 and a puller 5 detachably mounted with each other in this embodiment or integrally formed into one piece in another embodiment.

The latch 4 includes a body portion 41 defining a mounting slot 412 at a rear portion thereof and a sliding recess 411 in a substantially middle portion thereof, and a pair of stepped portions 413 formed at two opposite sides thereof The latch 4 further includes a latching portion 42 having a pair of connection beams 422 connected with the body portion 41, an opening 421 defined between the pair of beams 422, a resisting portion 423 connected with the pair of beams 422 and projecting toward the opening 421, and a pair of claws 424 projecting toward a first direction, i.e., an upward direction, formed in front of the resisting portion 423.

The cover 3 comprises a flat top wall 31, a pair of side walls 34 extending from two opposite side edges of the top wall 31, a tongue wall 32 extending forwardly from a front edge of the top wall 31, an abutting portion 33 extending downwardly from the tongue wall 32, and a plurality of locking holes 35 defined in the side walls 34.

Referring to FIGS. 1-5, in assembling of the plug connector 100, the circuit boards 21 are received in the receiving space 13 of the housing 1. The cable 200 is electrically connected to the circuit boards 21 via the bracket 201.

The releasing mechanism is assembled to the housing 1. The latch 4 is received in receiving recess 112, with the body portion 41 confined between the pair of ribs 118. The tab 115 is slidable in the sliding recess 411. The pair of beams 422 are received in the inclining recesses 116, and the projecting portion 114 project forwardly through the opening 114. In a latched position shown in FIG. 5, the resisting portion 423 is situated on the platform 110 adjacent to the projecting portion 114. The pair of claws 424 are disposed above the latching recesses 117. The puller 5 is mounted in mounting slot 412 of the latch 4. The cover 3 is attached to the base la of the housing 1, with the locking holes 35 locked with the locking protrusions 15. The latch 4 is sandwiched between the cover 3 and the top face 112. The resisting portion 423 is secured between the platform 110 and the abutting portion 33.

Figure 6:
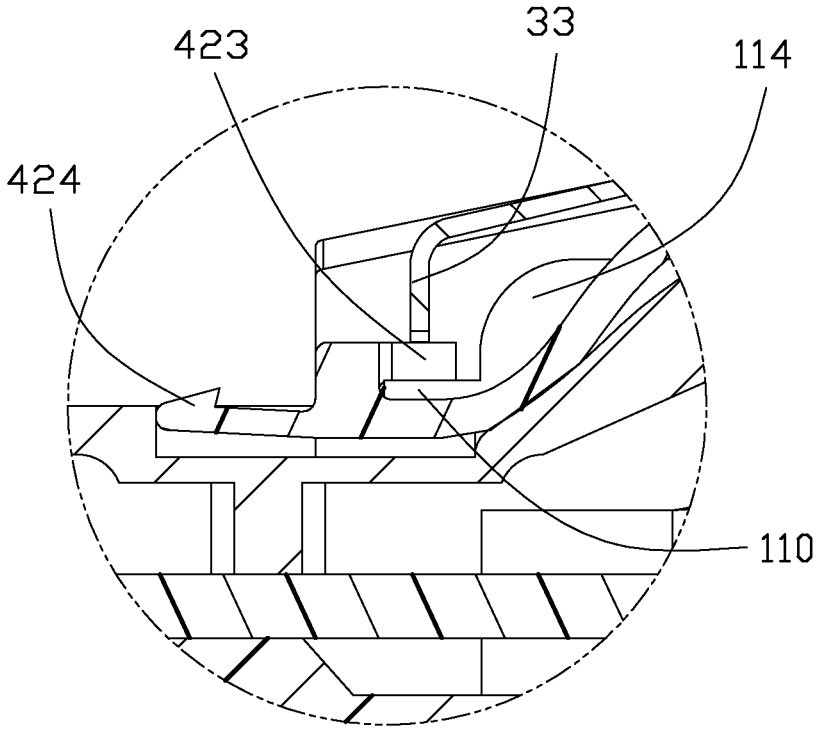
FIG. 6 is an enlarged view showing an engagement between the housing and the releasing mechanism situated in a latched position marked in FIG. 5.
Figure 7:
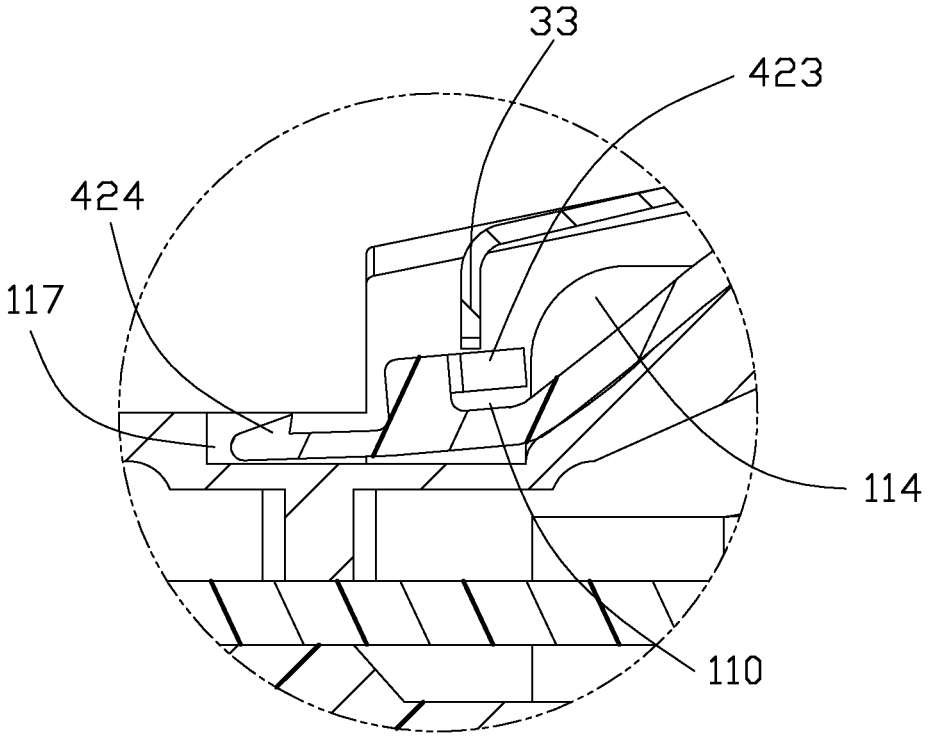
FIG. 7 is an enlarged view similar to FIG. 6, when the releasing mechanism is situated in a released position.

FIG. 6 illustrates the plug connector 100 located in a released position. When the body portion 41 of the latch 4 is pulled rearwardly by the puller 5, the latching portion 42 is pivoted about the resisting portion 423, with the resisting portion 423 abutting against the projecting portion 114. The pair of claws 424 are movable from a latched position to the released position where the claws 424 are received in the latching recesses 117 along a second direction, i.e., a downward direction. The tab 115 slides in the sliding recess 411 for alignment consideration and the stepped portions 413 abut against the ribs 118 to prevent the latch 4 from dropping off the housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector adapted for mating with a complementary connector, comprising:

a housing comprising a base and a tongue portion extending forwardly from the base for fitting with the complementary connector, said tongue portion defining at least one latching recess;

a cover attached to the housing; and a releasing mechanism assembled to the base and comprising:

a puller and a latch operable by the puller, the latch having a latching portion, the latching portion including a resisting portion for engaging the cover and the at least one claw in front of the resisting portion and projecting toward a first direction, the resisting portion, in response to a rearward movement of the puller, being movable to engage the cover and to pivot said at least one claw from a latched position to a released position where the at least one claw is received in said at least one latching recess along a second direction opposite to the first direction.

2. The plug connector as claimed in claim 1, wherein there are two claws formed on the latching portion, and there are two releasing recesses defined on the tongue portion of the housing.

3. The plug connector as claimed in claim 2, wherein said cover is attached to an upper side of the housing, said latch being disposed between the cover and the housing, said first direction being directed to an upward direction, said second direction being directed to a downward direction.

4. The plug connector as claimed in claim 3, wherein said cover has a downwardly extending abutting portion, and said tongue portion has a platform, said resisting portion being secured between the abutting portion and the platform.

5. The plug connector as claimed in claim 4, wherein said base includes a slope connected with the tongue portion and having a projecting portion, said resisting portion resisting against said projecting portion in the pivotal movement.

6. The plug connector as claimed in claim 5, wherein said latching portion comprises a pair of beams connected by the resisting portion and an opening between the pair of beams and adjacent to the resisting portion for accommodating said projecting portion.

7. The plug connector as claimed in claim 6, wherein said slope of the housing defines a pair of inclining recesses at two opposite sides thereof for accommodating said pair of beams.

8. The plug connector as claimed in claim 2, wherein said housing includes a receiving recess defined on the base, and said latch includes a body portion connected with the latching portion and received in the receiving recess.

9. The plug connector as claimed in claim 8, wherein said base has a pair of ribs formed at two opposite sides of the receiving recess for abutting two opposite sides of the body portion, and said body portion has a pair of stepped portions blocked by the pair of ribs.

10. The plug connector as claimed in claim 8, wherein said body portion defines a sliding recess, and said base has a tab formed in the receiving recess and sliding in the sliding recess.

11. The plug connector as claimed in claim 8, wherein said puller is detachably mounted at the body portion.

12. The plug connector as claimed in claim 8, wherein said puller is integrally formed with the body portion.

13. The plug connector as claimed in claim 1, wherein one of said cover and the housing includes a plurality of locking holes, and another one of said cover and the housing includes a plurality of locking protrusions locked with the locking holes.

14. A plug connector comprising:

a housing defining a mating port forwardly communicating with an exterior in a front-to-back direction;

a latch located upon an exterior surface of the housing behind the mating port and back and forth moveable along said front-to-back direction, said latch defining on a front end region a claw outwardly facing away from the mating port in a vertical direction perpendicular to said front-to-back direction, and on a rear end region a pulling section, and a connection section located between the claw and a pulling section in the front-to-back direction and moveably in an outward oblique direction; and an abutting portion inwardly confronting a resisting portion located on the front end region behind the claw; wherein upon rearwardly moving the pulling section, the connection section moves outwardly away from the mating port so as to have the claw move inwardly via a lever effect with a fulcrum formed between the abutting portion and the resisting portion.

15. The plug connector as claimed in claim 14, further including a puller attached to and located behind the pulling section.

16. The plug connector as claimed in claim 14, wherein said abutting portion is formed on a cover attached to the housing and cooperating with the housing to sandwich the latch therebetween in the vertical direction.

17. The plug connector as claimed in claim 16, further including a puller attached to and located behind the pulling section and exposed on the exterior behind the cover.

18. The plug connector as claimed in claim 14, wherein the resisting portion extends rearward in suspended manner.

19. The plug connector as claimed in claim 14, wherein the housing further defines a projection portion abutting against the resisting portion when the latch is moved rearwardly.

20. A plug connector comprising:

a housing defining a mating port forwardly communicating with an exterior in a front-to-back direction;

a latch located upon an exterior surface of the housing behind the mating port and back and forth moveable along said front-to-back direction, said latch defining on a front end region a claw outwardly facing away from the mating port in a vertical direction perpendicular to said front-to-back direction, and on a rear end region a pulling section;

alignment means formed between the latch and the housing to assure said latch to move relative to the housing in the front-to-back direction without tilting; and an abutting portion inwardly confronting a resisting portion located on the front end region behind the claw; wherein upon rearwardly moving the pulling section, the claw moves inwardly via a lever effect with a fulcrum formed between the abutting portion and the resisting portion.

* * * * *